US005436698A

United States Patent [19]

Ohtaka

[11] Patent Number: 5,436,698

[45] Date of Patent: Jul. 25, 1995

[54] IMAGE FORMING UNIT HAVING A DETACHABLE CARTRIDGE

[75] Inventor: Yoshimitsu Ohtaka, Shizuoka, Japan

[73] Assignee: Tokyo Electric Co., Ltd., Tokyo, Japan

[21] Appl. No.: 229,691

[22] Filed: Apr. 19, 1994

[30] Foreign Application Priority Data

Apr. 21, 1993 [JP] Japan ..... 5-094523
Feb. 7, 1994 [JP] Japan ..... 6-013553

[51] Int. Cl.[6] ..... G03G 21/00
[52] U.S. Cl. ..... 355/210; 355/200
[58] Field of Search ..... 355/200, 210, 211

[56] References Cited

U.S. PATENT DOCUMENTS 5,160,964 11/1992 Takahashi et al. ..... 355/200
5,257,068 10/1993 Sawada et al. ..... 355/200

FOREIGN PATENT DOCUMENTS 3-249766 11/1991 Japan .
4-51257 2/1992 Japan .
4-339678 11/1992 Japan .

*Primary Examiner*—A. T. Grimley
*Assistant Examiner*—Nestor R. Ramirez
*Attorney, Agent, or Firm*—Frishauf, Holtz, Goodman & Woodward

[57] ABSTRACT

The optical unit forms an electrostatic latent image by applying scanning light onto the photosensitive member charged by the charger device from above at an angle. The developing device forms a toner image by developing the electrostatic latent image formed on the photosensitive member with toner. The transfer charger device transfers the toner image formed on the photosensitive member onto a transfer charger sheet. The main body accommodates the sheet feeding section at a rear section, and the optical unit in front of the feeding section, both of which are vertically arranged. The photosensitive member and the developing device are integrated into the image formation unit, which is detachably set in the main body. The toner box of the developing unit has a rear surface portion shaped to correspond to the optical unit, and a front surface portion shaped to correspond to an optical path through which the scanning light output from the optical unit is applied onto the photosensitive surface of the electrostatic latent image carrier.

12 Claims, 9 Drawing Sheets

IMAGE FORMING UNIT HAVING A DETACHABLE CARTRIDGE

BACKGROUND OF THE INVENTION

1. Field of the Invention

The present invention relates to an image formation apparatus of an electrophotographic system, comprising an electrostatic latent image carrier such as a photosensitive drum, for use in a laser printer, a copying machine, etc.

2. Description of the Related Art

An image forming apparatus of an electrophotographic system, which comprises an electrostatic latent image carrier, for example, a photosensitive drum, has the structure in which a charge device, an exposure device, a development unit, a transfer changer device and a discharge device are arranged around the photosensitive drum.

In this image formation apparatus, the photosensitive surface of the photosensitive drum is charged uniformly by the charge device while rotating the drum.

The charged photosensitive surface of the drum is exposed to scanning light from an optical unit provided in the exposure device, thereby forming an electrostatic latent image on the surface. The electrostatic latent image is developed by toner applied thereon from the development unit so as to be visualized as a toner image.

The toner image is transferred on an image transfer sheet by the transfer charger device. The image transfer sheet to which the toner image has been transferred, is heated and pressed by a heat fixation device for fixation of the image.

Such an image formation apparatus is disclosed in, for example, Jap. Pat. Appln. KOKAI Publication No. 4-51257, or Jap. Pat. Appln. KOKAI Publication No. 3-249766.

According to Jap. Pat. Appln. KOKAI Publication No. 4-51257, the apparatus body 1 is divided into the upper body 1*a* and the lower body 1*b*, as shown in FIG. 9.

The upper body 1*a* has an image formation case 8 which further includes an optical writing device 2, a photosensitive drum 3, a charger device 4, a development device 5, a cleaning device 6 and a discharger device 7.

The lower body lb contains a transfer charger device 9, a fixation device 10 and a conveyer path 11. The lower body lb further includes a sheet feeding tray 13 detachably provided on the outer side of the conveying path 11, and in the tray, sheets 12 are stored.

The upper and lower bodies 1*a* and 1*b* of the apparatus body 1 are placed one on the other such that one end side can be opened while the other end side is hinged.

In the image formation apparatus having the above-described structure, the jamming of a sheet 12 on the conveyance path 11, the transfer charger device 9 or the fixation device 10 occurs in some cases. When it occurs, the upper and lower bodies 1*a* and 1*b* are opened, as shown in FIG. 10, so as to uncover the conveyance path 11, the transfer charger 9 and the fixation device 10, and the jammed paper is removed.

Jap. Pat. Appln. KOKAI Publication No. 3-249766 discloses an apparatus body 21 as shown in FIG. 11, in which a scanning optical system 22, a fixation device 23, a transfer charger roller 24, a paper-feeding cassette 25, etc are accommodated.

An image formation unit 29 comprising a photosensitive drum 26, a charger roller 27, a development device 28 and the like, may be set in the device body 21 by inserting from the upper surface thereof obliquely downward. The image formation unit 29 is set to the device body 21 such that the upper portion thereof is uncovered, and therefore it can be easily removed therefrom by pulling it upward, as shown in FIG. 12.

According to Jap. Pat. Appln. KOKAI Publication No. 4-51257, the apparatus body 1 has the structure in which the upper and lower bodies 1*a* and 1*b* can be opened at one side, and therefore a large-scale opening mechanism is necessary, which enlarges and complicates the apparatus.

In the case where the jamming of a sheet takes place at the fixation device, the upper body 1*a* must be opened, and a user must put his/her hand deep inside the apparatus to remove the jamming of the sheet. In practice, the upper body 1*a* serves to block the removal of the sheet, and therefore such an operation is difficult.

According to Jap. Pat. Appln. KOKAI Publication No. 3-249766, the apparatus body 21 has the structure in which the image formation unit 29 is inserted thereto obliquely downward, as shown in FIGS. 11 and 12. Therefore, the scanning optical system 22 accommodated in the upper body serves to cover the inside, and therefore it is not easy for the user to look inside. Thus removal of the jammed sheet is difficult. In the case where the size of the whole apparatus is decreased with the technique disclosed in Jap. Pat. Appln. KOKAI Publication No. 3-249766, the size of the image formation unit 29 is according reduced, thus making it difficult for the user to put his/her hand into the cavity in which the unit 29 is accommodated, after it is removed therefrom.

SUMMARY OF THE INVENTION

The first object of the present invention is to facilitate the detachment of the image information unit. The present invention also facilitates checking inside the apparatus by pulling out the image forming unit and also the insertion of a hand, even if the size of the device is reduced.

Thus, the removal of a Jammed sheet can be facilitated. Further, the contamination of the optical unit by toner can be prevented.

The second object of the invention is, in addition to the achievement of the first object, to prevent the deformation of the optical unit due to the thermal influence from the heat fixation device.

The third object of the invention is, in addition to the achievement of the first object, to facilitate the alignment of the image forming unit with respect to the apparatus body for setting up.

The fourth object of the invention is, in addition to the achievement of the first object, to improve the utility of the apparatus by stacking and holding outputted image transfer sheets on the upper portion of the apparatus body.

According to the present invention, there is provided an image formation apparatus comprising: charger means for charging the photosensitive surface of the electrostatic latent image carrier; an optical unit for forming an electrostatic latent image on the photosensitive surface of the electrostatic latent image carrier charged by the charger means by exposing the photosensitive surface to scanning light applied onto the photosensitive surface; developing means for forming a toner image on the photosensitive surface of the electrostatic latent image carrier by developing the electrostatic latent image formed by the optical unit with toner supplied from a toner box; an image formation unit consisting of at least the electrostatic latent image carrier and the developing means; sheet feeding means for feeding a transfer charger sheet on which a toner image is transferred; transfer charger means for transferring the toner image formed on the photosensitive surface of the electrostatic latent image carrier onto the transfer charger sheet supplied from the sheet feeding means; and a main body for accommodating the sheet feeding means at a rear section in a longitudinal arrangement and the optical unit in front of the sheet feeding means, and the image formation unit detachably provided in an upper section thereof, wherein the optical unit is used to apply the scanning light onto the photosensitive surface of the electrostatic latent image carrier from above at an angle, and the developing means has the toner box having a rear surface portion which is shaped to correspond to the optical unit, and a front surface portion which is shaped to correspond to an optical path through which the scanning light output from the optical unit is applied onto the photosensitive surface of the electrostatic latent image carrier.

According to the present invention, there is also provided an image formation apparatus comprising: charger means for charging the photosensitive surface of the electrostatic latent image carrier; an optical unit for forming an electrostatic latent image on the photosensitive surface of the electrostatic latent image carrier charged by the charger means by exposing the photosensitive surface to scanning light applied onto the photosensitive surface; developing means for forming a toner image on the photosensitive surface of the electrostatic latent image carrier by developing the electrostatic latent image formed by the optical unit with toner supplied from a toner box; an image formation unit consisting of at least the electrostatic latent image carrier and the developing means; sheet feeding means for feeding a transfer charger sheet on which a toner image is transferred; transfer charger means for transferring the toner image formed on the photosensitive surface of the electrostatic latent image carrier onto the transfer charger sheet supplied from the sheet feeding means; a heat fixation device for heat-fixing the transfer charger sheet on which the toner image was transferred by the transfer charger means; and a main body for accommodating the sheet feeding means at a rear section in a longitudinal arrangement and the optical unit in front of the sheet feeding means, and the image formation unit detachably provided in an upper section thereof, wherein the optical unit is used to apply the scanning light onto the photosensitive surface of the electrostatic latent image carrier from above at an angle, and the developing means has the toner box having a rear surface portion which is shaped to correspond to the optical unit, and a front surface portion which is shaped to correspond to an optical path through which the scanning light output from the optical unit is applied onto the photosensitive surface of the electrostatic latent image carrier.

According to the present invention, there is also provided an image formation apparatus comprising: charger means for charging the photosensitive surface of the electrostatic latent image carrier; an optical unit for forming an electrostatic latent image on the photosensitive surface of the electrostatic latent image carrier charged by the charger means by exposing the photosensitive surface to scanning light applied onto the photosensitive surface; developing means for forming a toner image on the photosensitive surface of the electrostatic latent image carrier by developing the electrostatic latent image formed by the optical unit with toner supplied from a toner box; an image formation unit consisting of at least the electrostatic latent image carrier and the developing means; sheet feeding means for feeding a transfer charger sheet on which a toner image is transferred; transfer charger means for transferring the toner image formed on the photosensitive surface of the electrostatic latent image carrier onto the transfer charger sheet supplied from the sheet feeding means; a main body for accommodating the sheet feeding means at a rear section in a longitudinal arrangement and the optical unit in front of the sheet feeding means, and the image formation unit detachably provided in an upper section thereof; an aligning protruding portion or a recess portion formed in the image formation unit; and a guide portion formed in the main body, to be engaged with the aligning protruding portion or recess portion when the image formation unit is set in; wherein the optical unit is used for applying the scanning light onto the photosensitive surface of the electrostatic latent image carrier from above at an angle, and the developing means has the toner box having a rear surface portion which is shaped to correspond to the optical unit, and a front surface portion which is shaped to correspond to an optical path through which the scanning light output from the optical unit is applied onto the photosensitive surface of the electrostatic latent image carrier.

According to the present invention, there is also provided an image formation apparatus comprising: charger means for charging the photosensitive surface of the electrostatic latent image carrier; an optical unit for forming an electrostatic latent image on the photosensitive surface of the electrostatic latent image carrier charged by the charger means by exposing the photosensitive surface to scanning light applied on the photosensitive surface; developing means for forming a toner image on the photosensitive surface of the electrostatic latent image carrier by developing the electrostatic latent image formed by the optical unit with toner supplied from a toner box; an image formation unit consisting of at least the electrostatic latent image carrier and the developing means; sheet feeding means for feeding a transfer charger sheet on which a toner image is transferred; transfer charger means for transferring the toner image formed on the photosensitive surface of the electrostatic latent image carrier onto the transfer charger sheet supplied from the sheet feeding means; a main body for accommodating the sheet feeding means at a rear section in a longitudinal arrangement and the optical unit in front of the sheet feeding means, and the image formation unit detachably provided in an upper section thereof; a transfer charger sheet outlet formed in a front portion of the main body; and a guiding mechanism, provided at an outer section of the sheet outlet so as to be detachable from the main body, for guiding a transfer charger sheet output from the sheet outlet to an upper portion of the main body; wherein the optical unit is used for applying the scanning light onto the photosensitive surface of the electrostatic latent image carrier from above at an angle, and the developing means has the toner box having a rear surface portion which is shaped to correspond to the optical unit, and a front surface portion which is shaped to correspond to an optical path through which the scanning light output from the optical unit is applied onto the photosensitive surface of the electrostatic latent image carrier.

According to the present invention, there is also provided an image formation apparatus comprising: charger means for charging the photosensitive surface of the electrostatic latent image carrier; an optical unit for forming an electrostatic latent image on the photosensitive surface of the electrostatic latent image carrier charged by the charger means by exposing the photosensitive surface to scanning light applied on the photosensitive surface; developing means for forming a toner image on the photosensitive surface of the electrostatic latent image carrier by developing the electrostatic latent image formed by the optical unit with toner supplied from a toner box; an image formation unit consisting of at least the electrostatic latent image carrier and the developing means; sheet feeding means for feeding a transfer charger sheet on which a toner image is transferred; transfer charger means for transferring the toner image formed on the photosensitive surface of the electrostatic latent image carrier onto the transfer charger sheet supplied from the sheet feeding means; a main body for accommodating the sheet feeding means at a rear section in a longitudinal arrangement and the optical unit in front of the sheet feeding means, and the image formation unit detachably provided in an upper section thereof; and a sheet feeding cassette provided detachably on a bottom surface of the main body, for feeding a sheet selectively in cooperation with the sheet feeding means; wherein the optical unit is used for applying the scanning light onto the photosensitive surface of the electrostatic latent image carrier from above at an angle, and the developing means has the toner box having a rear surface portion which is shaped to correspond to the optical unit, and a front surface portion which is shaped to correspond to an optical path through which the scanning light output from the optical unit is applied onto the photosensitive surface of the electrostatic latent image carrier.

According to the present invention, there is also provided an image formation apparatus comprising: charger means for charging the photosensitive surface of the electrostatic latent image carrier; an optical unit for forming an electrostatic latent image on the photosensitive surface of the electrostatic latent image carrier charged by the charger means by exposing the photosensitive surface to scanning light applied on the photosensitive surface; developing means for forming a toner image on the photosensitive surface of the electrostatic latent image carrier by developing the electrostatic latent image formed by the optical unit with toner supplied from a toner box; an image formation unit consisting of at least the electrostatic latent image carrier and the developing means; sheet feeding means for feeding a transfer charger sheet on which a toner image is transferred; and transfer charger means for transferring the toner image formed on the photosensitive surface of the electrostatic latent image carrier onto the transfer charger sheet supplied from the sheet feeding means; a main body for accommodating the sheet feeding means at a rear section in a longitudinal arrangement and the optical unit in front of the sheet feeding means, and the image formation unit detachably provided in an upper section thereof; a transfer charger sheet outlet formed in a front portion of the main body; a guiding mechanism, provided at an outer section of the sheet outlet so as to be detachable from the main body, for guiding a transfer charger sheet output from the sheet outlet to an upper portion of the main body; a sheet feeding cassette provided detachably on a bottom surface of the main body, for feeding a sheet selectively in cooperation with the sheet feeding means; a stacker, provided on an upper surface of the sheet feeding cassette situated in front of the outlet of the main body, for stacking and holding sheets; and a switching nail to be situated adjacent to the outlet, for switching the output direction of transfer charger sheet so that a sheet is guided to the guiding mechanism, or is output to the stocker; wherein the optical unit is used for applying the scanning light onto the photosensitive surface of the electrostatic latent image carrier from above at an angle, and the developing means has the toner box having a rear surface portion which is shaped to correspond to the optical unit, and a front surface portion of which is shaped to correspond to an optical path through which the scanning light output from the optical unit is applied onto the photosensitive surface of the electrostatic latent image carrier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

EMBODIMENT 1

Figure 1:
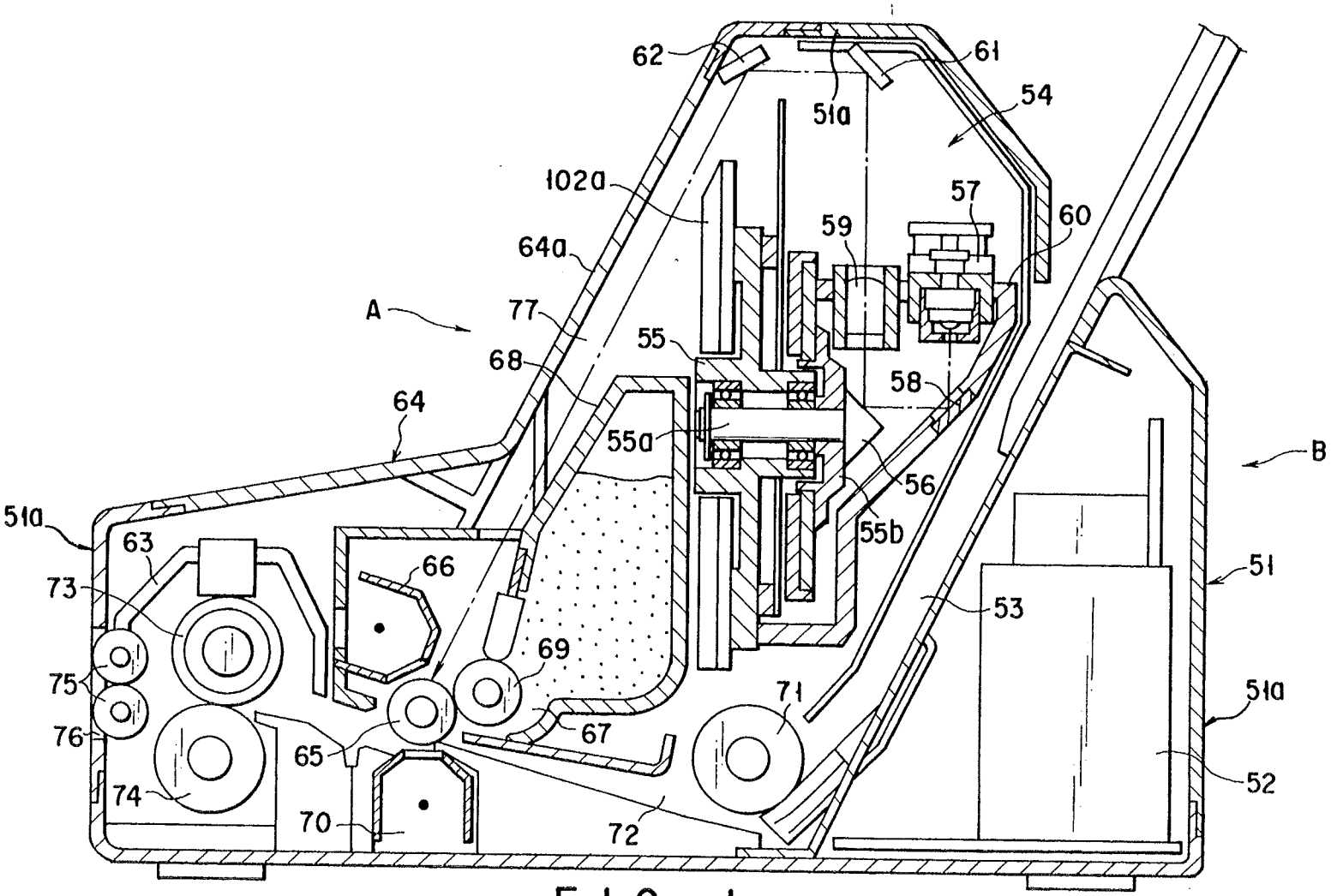
FIG. 1 is a cross section of the first embodiment of the present invention.
Figure 2:
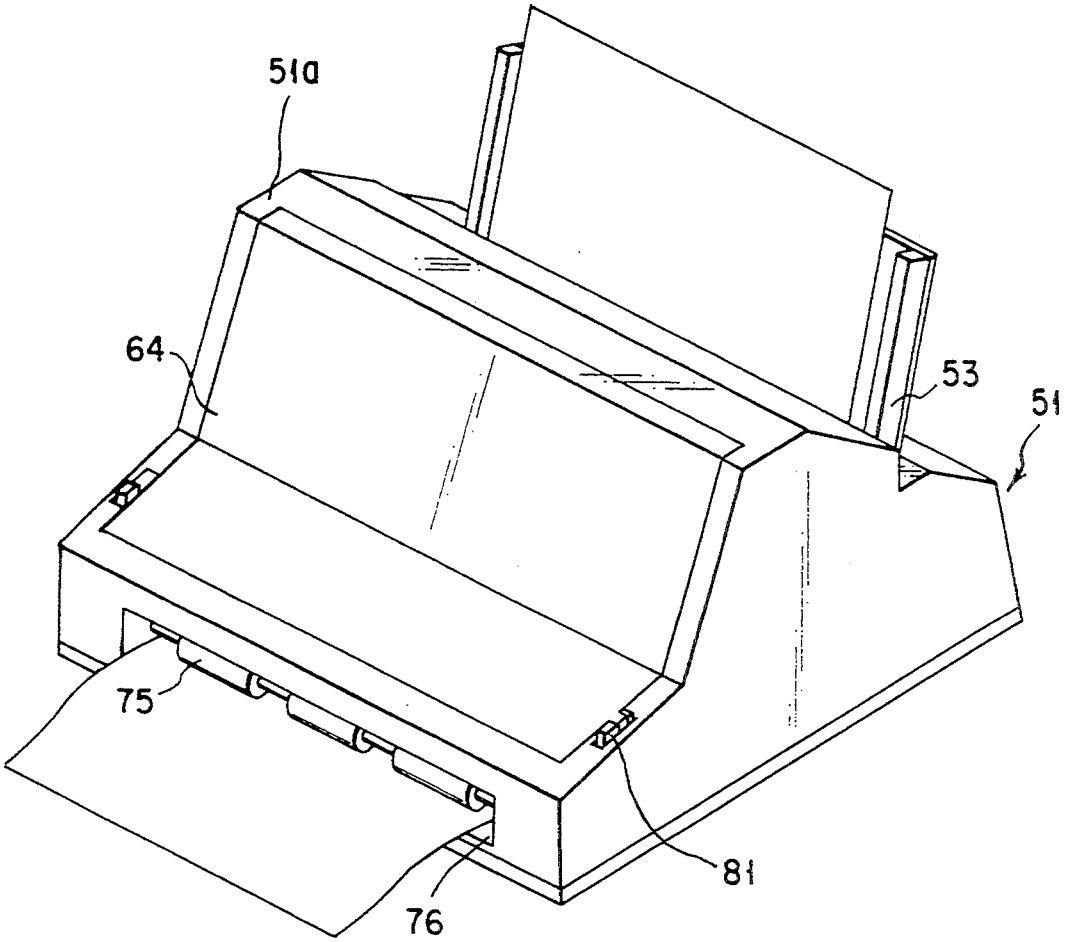
FIG. 2 is a schematic view showing an appearance of the embodiment.

FIG. 1 is a cross section showing an internal structure of this embodiment, and FIG. 2 is a schematic view of the embodiment.

An apparatus main body 51 has a side A as a front surface, and a side B as a rear surface. The apparatus main body 51 accommodates a power source 52 and other circuit parts at a lower portion of the deepest section in the main body cover 51*a*.

A sheet feeding section 53 is situated at an angle in front of the power 52. An optical unit 54 is arranged vertically in front of the sheet feeding section 53. The optical unit 54 consists of a scanning unit 60, and two reflection mirrors 61 and 62 for guiding a light beam emitted directly above from the scanning unit 60 to a surface of an electrostatic latent image carrier, for example, a photosensitive member 65.

The scanning unit 60 consists of a motor 55, a rotor 55*b* fixed to a rotation shaft 55*a* of the motor 55, a rectangular prism 56 fixed to the rotor 55*b* and having two reflection surfaces for emitting a scanning light beam converted from light irradiated on the reflection surfaces by rotation, a laser oscillator 57, a reflection mirror 58 for reflecting a laser beam from the laser oscillator 57 and radiating the laser beam onto the reflection surfaces of the rectangular prism 56, and a meniscus lens 59 for focusing the reflected light from the reflection surfaces of the rectangular prism 56 on the surface of the photosensitive member, all integrated into one body.

The scanning unit 60 serves to guide the reflected light from the reflection surface of the rectangular prism 56 onto the surface of the photosensitive member 65 as a scanning light which scans horizontally, as the rotor 55*b* and the rectangular prism 56 are rotated by means of the motor 55.

The apparatus main body 51 accommodates a heatfixation device 63 at the most front portion thereof.

The image formation unit 64 detachably mounted to the main body 51 is disposed between the heat-fixation device 63 and the optical unit 54.

The image formation unit 64 consists of the photosensitive member 65, a charger device 66 and a developing device 67, all integrated into one body, and the charger device 66 and the developing device 67 are arranged around the photosensitive member 65.

The developing device 67 consists of a toner box 68 and a developing roller 69 for supplying toner in the toner box 68 to the photosensitive member 65.

The toner box 68 has a back surface portion extending in a vertical direction along the optical unit 54. More specifically, the back surface portion of the toner box 68 extends in a vertical direction along a beam portion 102a of a frame which fixes the scanning unit 60 and constitutes the optical unit 54.

The toner box 68 has a front surface portion extending up at an angle to correspond to an optical path 77 through which a scanning light beam from the reflection mirror 62 is made incident on the photosensitive member 65 from above at an angle.

The image formation unit 64 has a cover portion 64*a*, which is also a part of a case surface of the apparatus main body 51. The image formation unit 64 has a space portion defined between an inner wall surface of the cover portion 64*a* and a front surface portion of the toner box 68, and the space portion serves as the optical path 77.

The transfer charger device 70 is situated, independent from the image formation unit 64, in a lower position such as to face the photosensitive member 65.

A sheet stored in the sheet feeding section 53 is first fed onto a conveying path 72 formed in the bottom portion of the main body 51 by a sheet feeding roller 71. After that, the sheet is allowed to pass between the photosensitive member 65 and the transfer charger device 70, and then between a heat roller 73 of the heat fixation device 63 and a pressure roller 74. Lastly, the sheet is output from an outlet opening 76 by an output roller 75.

Figure 3:
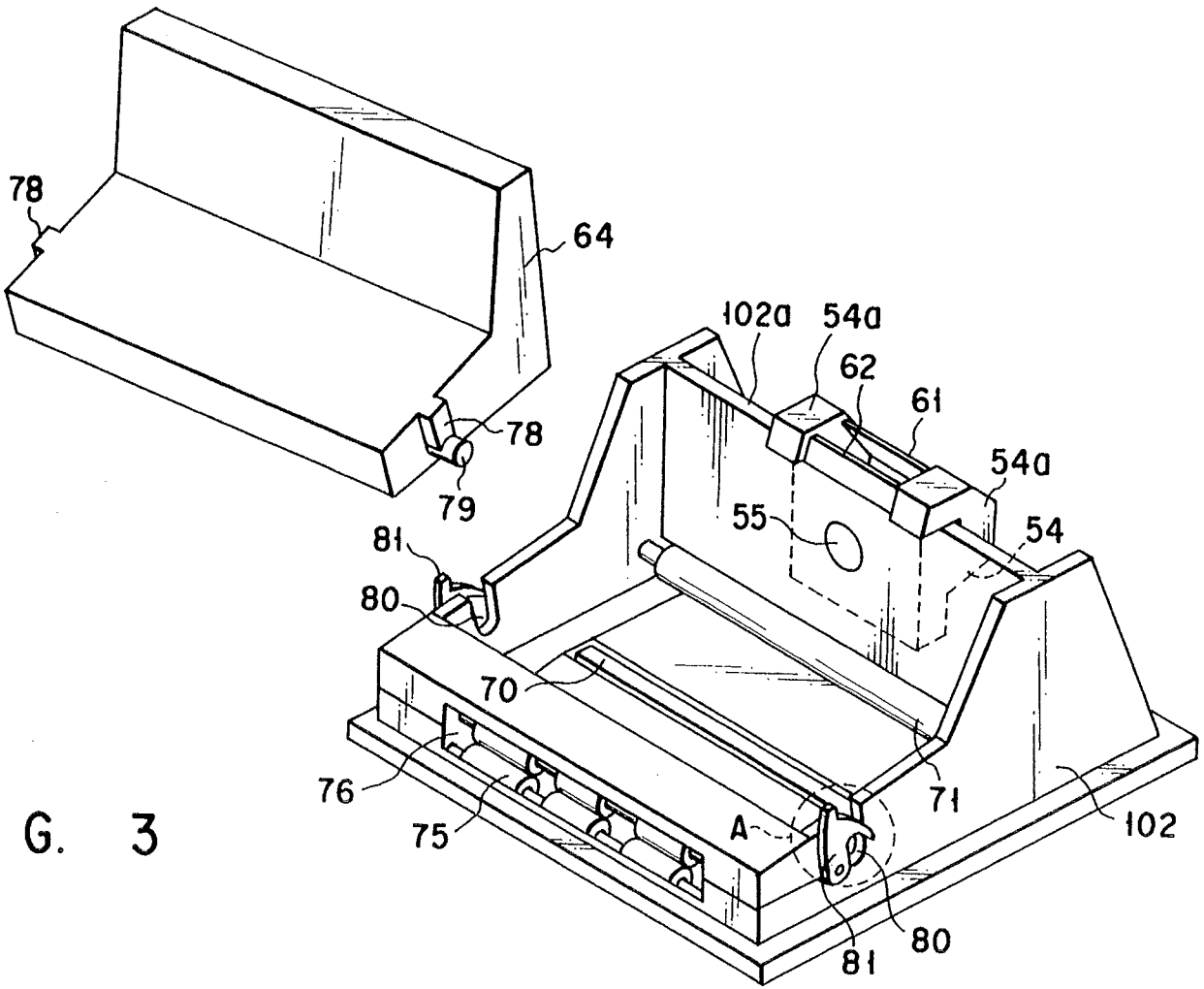
FIG. 3 is a schematic view showing an appearance of each of the frame portion of the embodiment and the image formation unit mounted on the frame portion.

FIG. 3 is a diagram showing this embodiment when a main cover 51a is removed, and as shown in this figure, the apparatus main body 51 has a frame 102 inside. The frame 102 is provided for fixing the power source 52, the sheet feeding section 53, the optical unit 54, the heat fixation device 63, the transfer charger device 70, the sheet feeding roller 71, the output roller 75, etc.

The frame 102 includes the beam portion 102*a*, to which the optical unit 54 is fixed.

The reflection mirrors 61 and 62 are fixed to an arm portion 54*a* of the optical unit 54.

The image formation unit 64 has aligning protrusions 78 on both sides in a front periphery portion. Underneath each protrusion 78, a fixation portion 79 is formed coaxially with the shaft of the photosensitive member 65 shown in FIG. 1.

The frame 102 has a notch-like guide portion 80 on both front periphery sides. This set of notch-like guide portions 80 serves to guide the aligning protrusion portions 78 when the image forming unit 64 is mounted on the main body 51 shown in FIG. 1.

Figure 4:
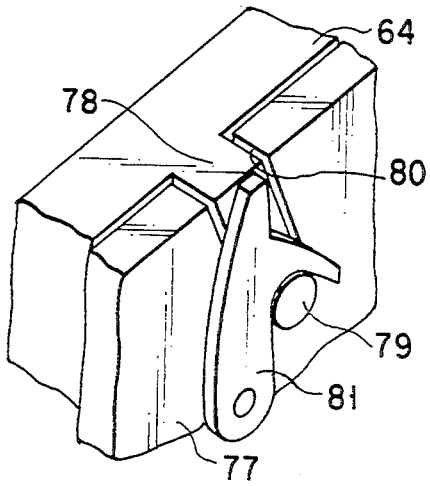
FIG. 4 is an enlarged schematic view showing the section defined by dot line A in FIG. 3.

The frame 102 also has a lock lever 81 mounted rotatably on both front periphery sides. The lock lever 81 is situated adjacent to the guide portion 80, and hooked with the fixation portion 79 of the image formation unit 64 as shown in FIG. 4, when the aligning protrusion portion 78 of the image formation unit is guided to the guide portion 80. Thus, the image formation unit 64 is fixed to the apparatus main body 51.

The operation of this embodiment will now be described.

For starting a printing operation, the rotation of the motor 55 in the scanning unit 60 is initiated, and so is the oscillation of the laser oscillator 57.

A laser beam output from the laser oscillator 57 reflects on the reflection mirror 58, and then on the reflection surfaces of the rectangular prism 56 rotated by the motor 55 to be converted into a scanning light beam which scans in the rotation direction of the rectangular prism 56.

The scanning light beam is emitted above via the meniscus lens 59, and reflects on the reflection mirrors 61 and 62. The scanning light beam reflected upon the mirrors 61 and 62 is allowed to pass downward at an angle along the optical path 77 formed in the image formation unit 64, and made incident on the surface of the photosensitive member 65.

The photosensitive member 65 is, as it rotates, charged evenly by the charger device 66, and then exposed to the irradiation of the scanning light beam.

This exposure is carried out on the basis of recording information, and thus the photosensitive member 65 records the recording information on its surface as an electrostatic latent image.

After that, toner is supplied from the developing device onto the recorded electrostatic latent image, and thus the latent image is visualized as a toner image.

In the meantime, a transfer charger sheet stored in the sheet feeding section 53 is output onto the conveying path 72 by means of the sheet feeding roller 71. Then, the toner image is transferred onto the transfer charger sheet, from the photosensitive member 65 as the sheet proceeds between the photosensitive member 65 and the transfer charger device 70 which face with each other.

The toner image which was transferred on the transfer charger sheet is heat-fixed thereon by the heat-fixation device 63, and output from the outlet opening 76 by the output roller 75.

Figure 5:
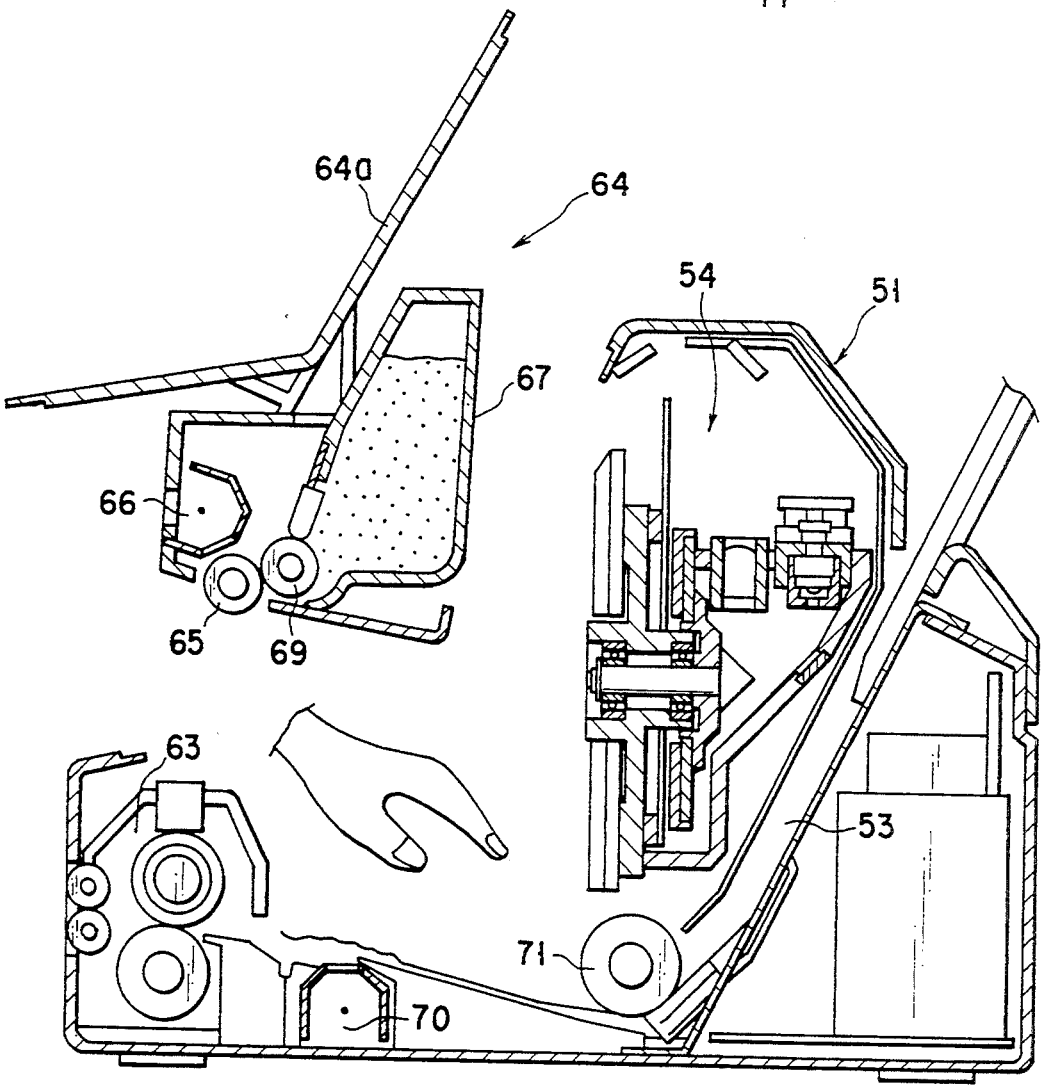
FIG. 5 is a cross section of the embodiment when the image formation unit is removed from the apparatus main body.

During a series of printing operations, if the jamming of a transfer charger sheet occurs, for example, before the heat-fixation device 63, the lock lever 81 is rotated to release the engagement between the lever 81 and the fixation portion 79. Then, as shown in FIG. 5, the image formation unit is pulled up.

Thus, the image formation unit 64 in which the photosensitive member 65, the charger device 66 and the developer device 67 are integrated, is removed from the main body 51.

After the removal of the image formation unit 64, the conveying path for sheets is disclosed, and a large cavity is left.

Therefore, the user can put his/her hand into this cavity to take away the sheet jammed in the main body 51.

In this image formation apparatus, the sheet feeding section 53 and the optical unit 54 are accommodated in a vertical arrangement in the rear side in the apparatus main body 51, and the heat-fixation device 63 is accommodated in the front side therein. Further, the image formation unit 64 is disposed between the optical unit 54 and the heat-fixation device 63 such that the unit 64 can be mounted on or removed from the upper section of the main body 51.

As described above, with this apparatus, the image formation unit 64 can be easily mounted on or removed from the apparatus main body 51. Further, when the image formation unit 64 is set in the main body, there is substantially no space left inside the apparatus. Thus, the whole structure can be made compact, thereby downsizing the apparatus.

In this apparatus, even it is downsized, the cavity left after the removal of the image formation unit 64, will have a space which extends towards the outside, with a large width. Therefore, the user can easily put his/her hand thereinto if the jamming of a sheet occurs.

Further, in the apparatus, the optical unit 54 and the image formation unit 64 are arranged on the frame 102 but separated away from each other in the front and rear section by the beam portion 102*a*, and the photosensitive member 65 is situated below the optical unit 54. With this structure, part of toner used for development may be spilled, but the optical unit 54 is never contaminated.

The optical unit 54 is situated on the opposite side to the heat-fixation device 63 via the photosensitive member 65 and the developing device 67, and therefore is substantially never thermally affected by the heat-fixation device 63. Consequently, the optical unit 54 is never deformed by heat generated in the heatfixation device 63, thus assuring a stable operation.

The image formation unit 64 is set into the main body 51 by inserting the unit thereinto while engaging the aligning protrusions 78 with the guide portions 80 of the main body 51.

As just described, the image formation unit 64 can be accurately and easily aligned with respect to the main body 51.

After the unit 64 has been set, the lock lever 81 is rotated to be hooked with the fixation portion 79. Thus, the image formation unit 65 is fixed to be integrated with the apparatus main body 51.

As the aligning protrusions 78 and the guide portions 80 are engaged with each other, the image formation unit 64 cannot be rotated back and forth, but is firmly fixed to the main body.

In this embodiment, the scanning unit 60 is formed by integrating the motor 55, the rectangular prism 56, the laser oscillator 57, the reflection mirror 58 and the meniscus lens 59, but the unit may have a structure in which the laser oscillator 57, the reflection mirror and the meniscus lens 59 are directly mounted on the frame without being integrated, and the motor 55 and the rectangular prism 56 are further set thereon.

EMBODIMENT 2

Figure 6:
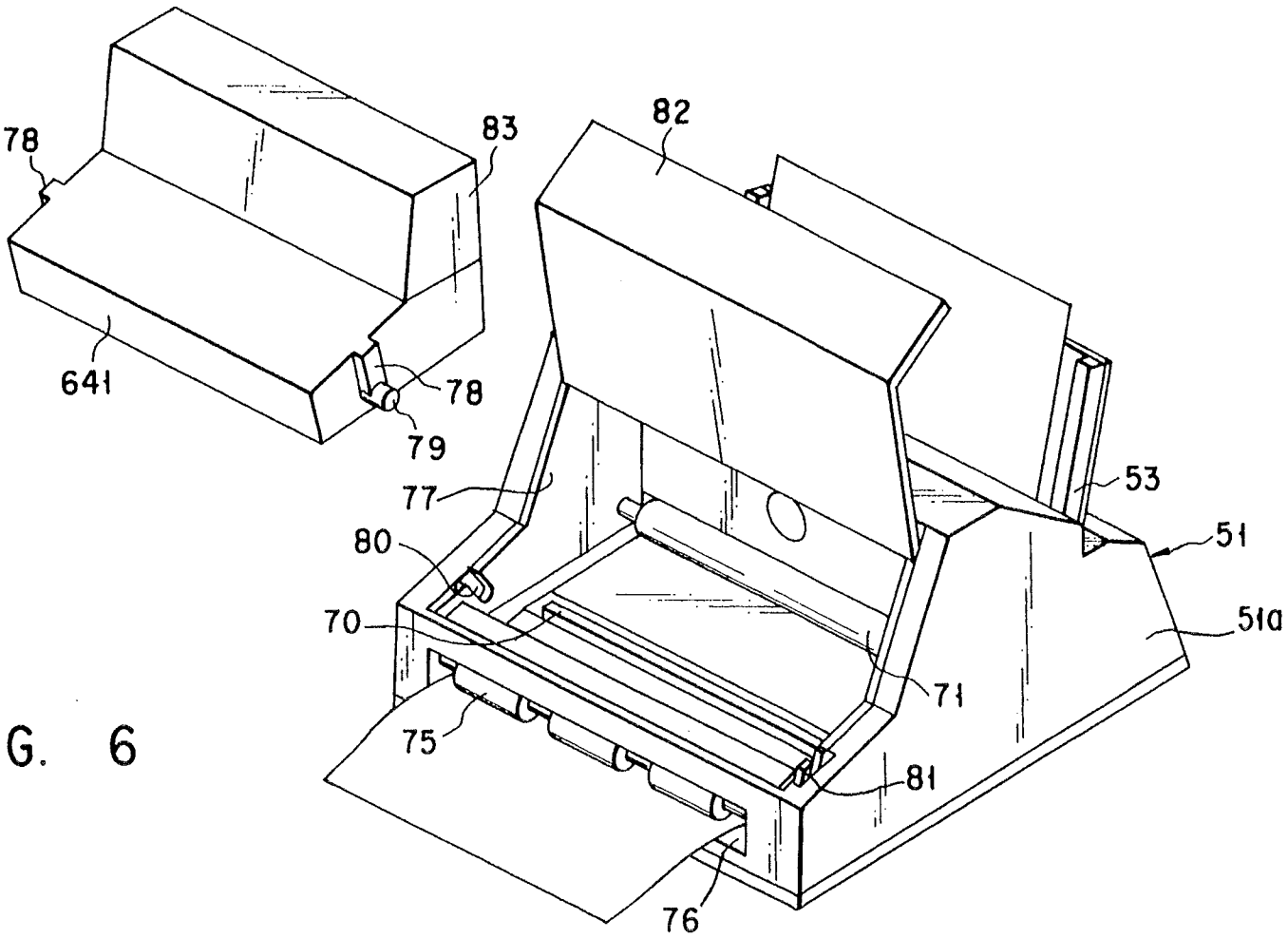
FIG. 6 is a schematic view of the second embodiment.

As can be seen in FIG. 6, an image formation unit does not have a cover portion. A cover 82 is openably set on an apparatus main body 51.

In order to set the image formation unit 641 into the main body 51, the cover 82 is lifted above as shown in FIG. 6, and the unit 641 is set into the main body 51 while engaging aligning protrusions 78 with guide portions 80 of the main body 51 as in the first embodiment.

A developing device has a small toner box, and a toner supplement cartridge 83 is provided above the toner box such that the cartridge can be replaced by another.

The cover 82, as it opens/closes, drives the lock lever 81. More specifically, as the cover is opened, the engagement between the lock lever 81 and the fixation portion 79 is released, and the cover 82 is closed, the lever 81 is hooked with the fixation portion 79. The structure within the main body 51 will not be discussed, but is similar to that of the first embodiment.

In the second embodiment, the lock lever 81 is interlocked with the cover 82, and as the cover is opened/closed, the lock between the lever and the fixation portion 79 is released, or the lever is locked therewith, respectively. With this structure, it should suffice if the cover 82 is opened/closed to set or remove the image formation unit 641 into or from the apparatus main body 51. Therefore, the image formation unit 641 can be easily set to or removed from the apparatus main body 51.

Further, the developing device of this embodiment uses an exchangeable toner supplement cartridge 83, and therefore the life time of the image formation unit 641 is no limited by the toner capacity of the developing device. Thus, the image formation unit 641 can be used continuously for a long period of time only by replacing the toner supplement cartridge 83 with a new one.

In similar to the first embodiment, with the second embodiment, the apparatus can be downsized, a jammed sheet can be easily removed, and the thermal influence from the heat-fixation device on the optical unit can be avoided.

EMBODIMENT 3

Figure 7:
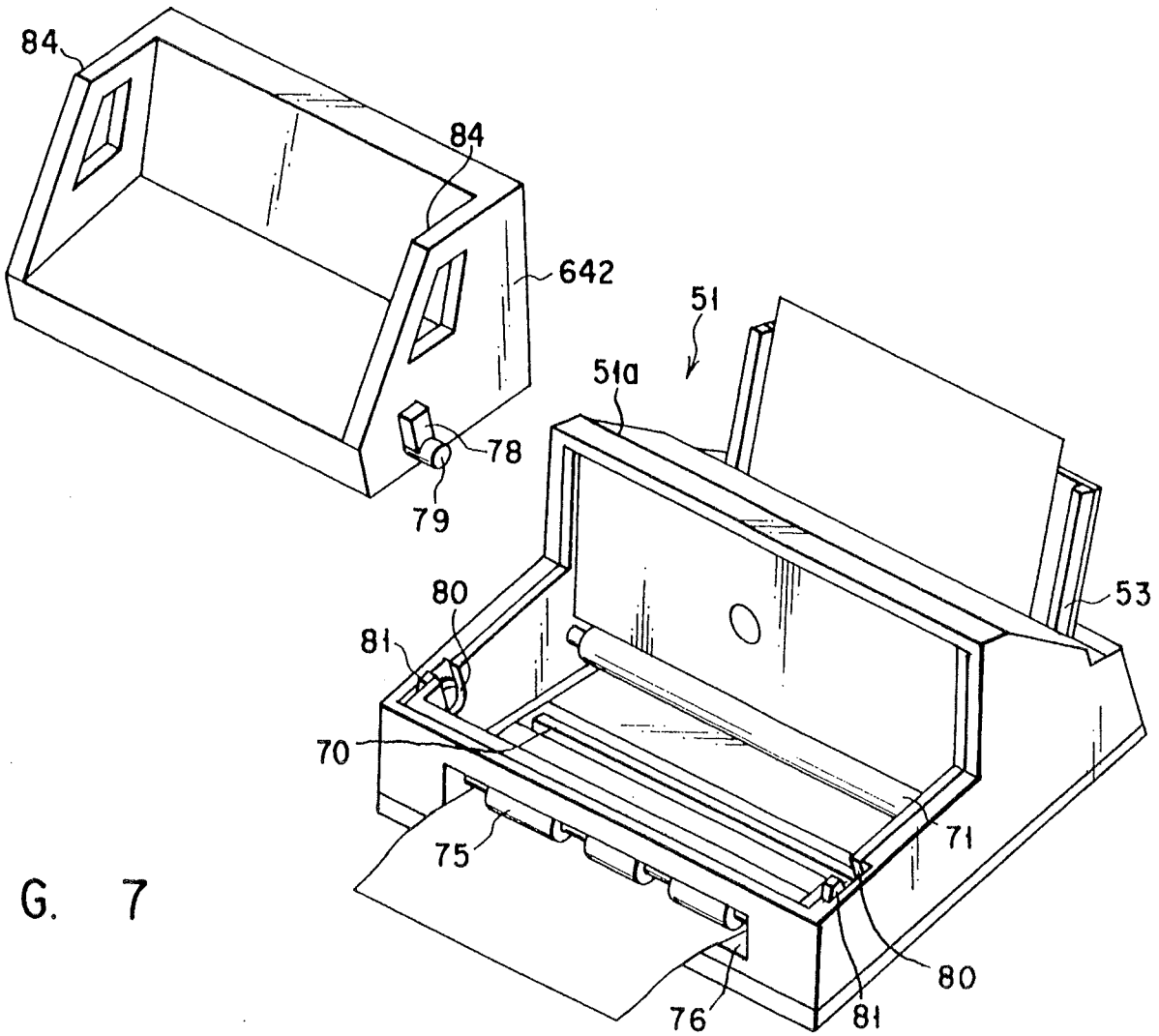
FIG. 7 is a schematic view of the third embodiment.

As can be seen in FIG. 7, an image formation unit 642 has a handle 84 on both sides.

Except for the above, this embodiment has the same structure as that of the first embodiment.

According to the third embodiment, the work for setting or removing the image formation unit 642 into or from the main body 51 can be further facilitated by using the handles 84 provided on the unit 642.

In similar to the first embodiment, with the third embodiment, the apparatus can be downsized, a jammed sheet can be easily removed, and the thermal influence from the heat-fixation device on the optical unit can be avoided.

EMBODIMENT 4

Figure 8:
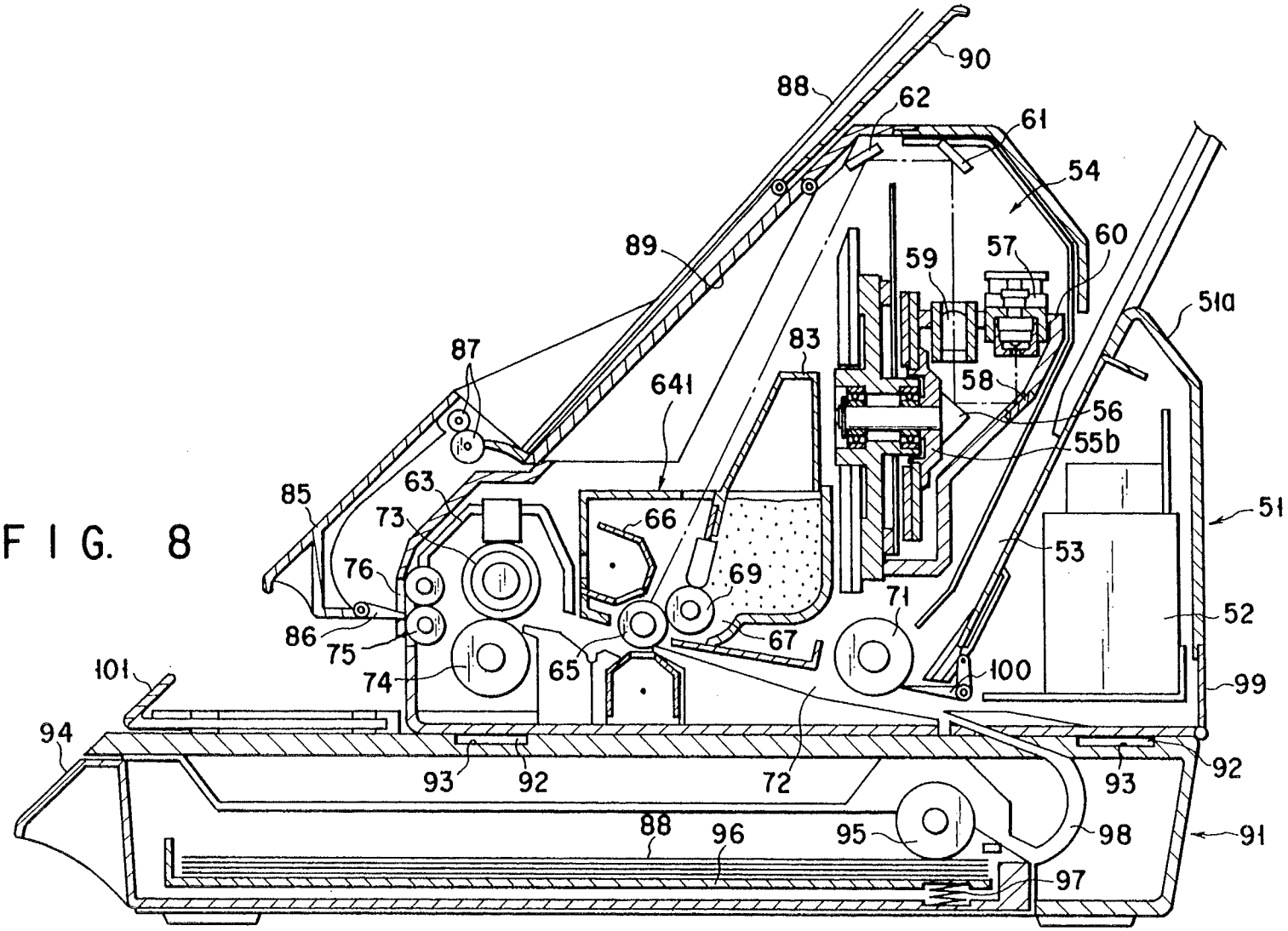
FIG. 8 is a schematic view of the fourth embodiment.
Figure 9:
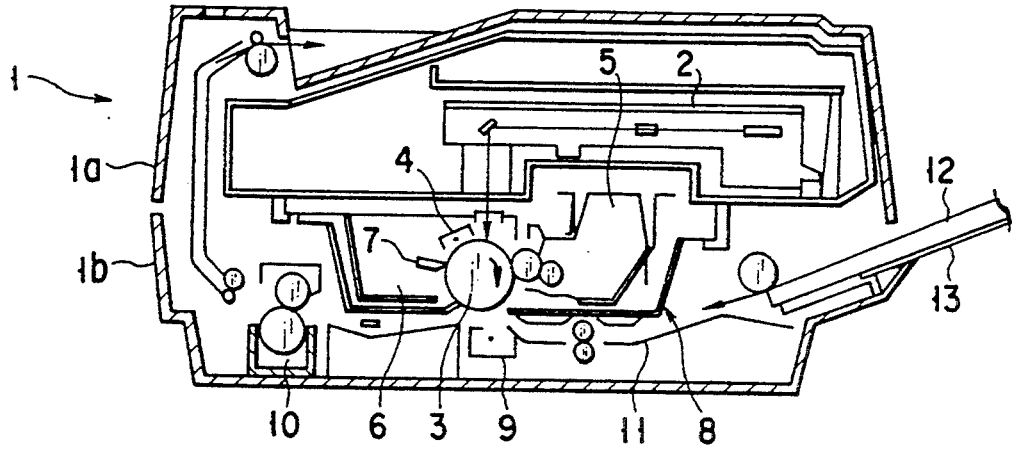
FIG. 9 (PRIOR ART)
FIG. 9 is a cross section of an example of the prior art.
Figure 10:
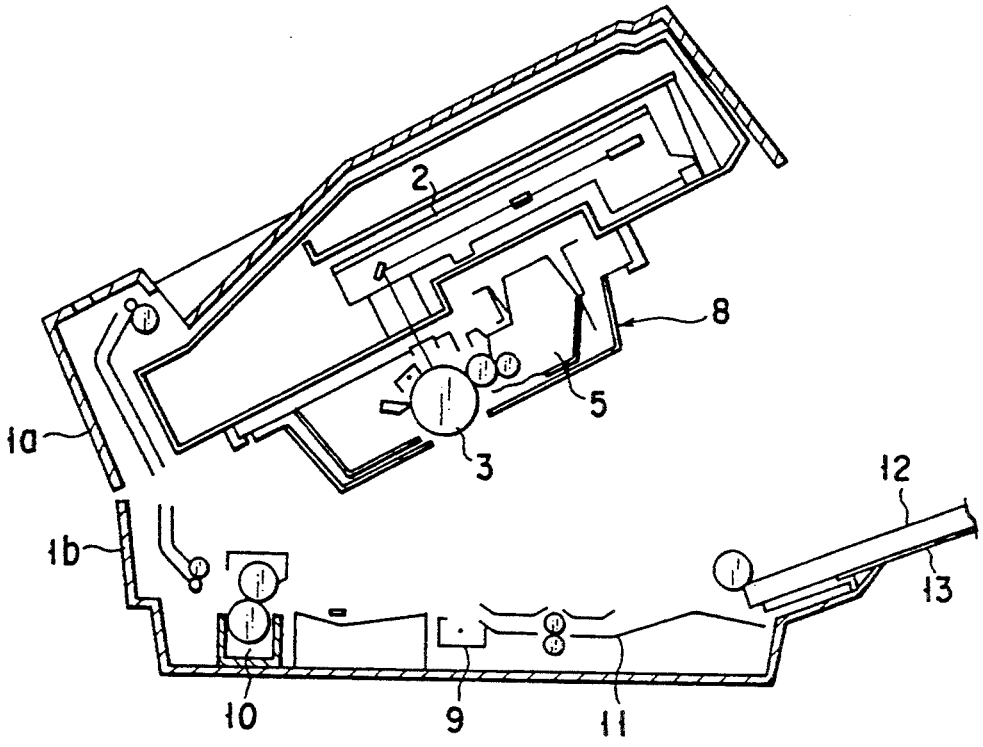
FIG. 10 (PRIOR ART)
FIG. 10 is a cross section of the prior art example when the upper section of the main body is opened.
Figure 11:
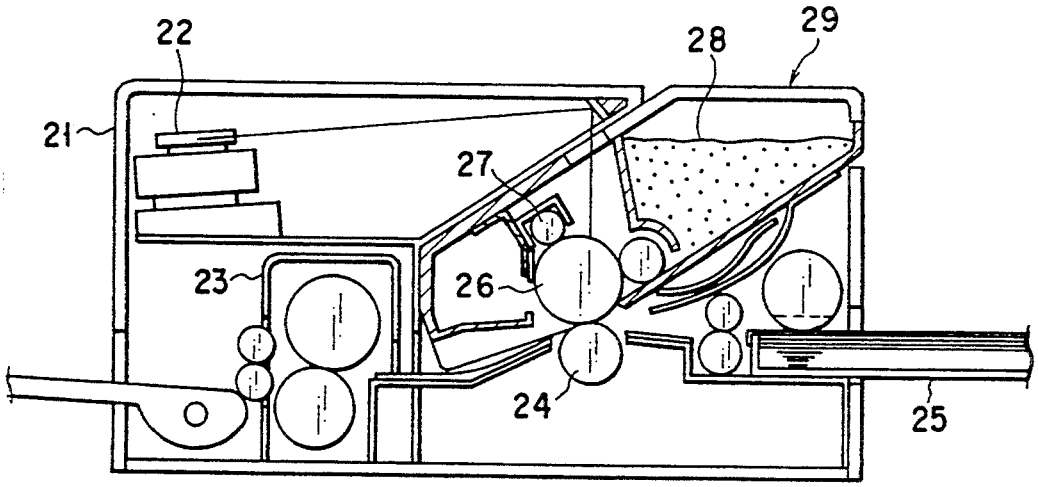
FIG. 11 (PRIOR ART)
FIG. 11 is a cross section of another example of the prior art.
Figure 12:
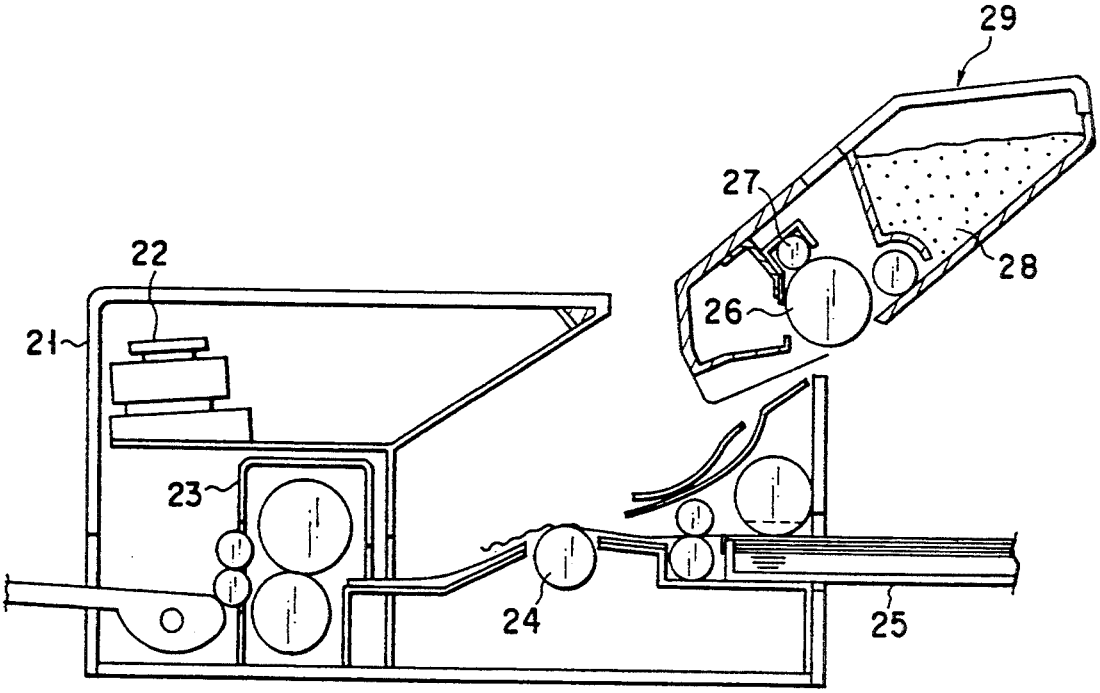
FIG. 12 (PRIOR ART)
FIG. 12 is a cross section of the prior art example shown in FIG. 11 when the image formation unit of the main body is opened.

As can be seen in FIG. 8, the apparatus according to this embodiment includes a guiding mechanism 85 for guiding a transfer charger sheet output to the outside from the outlet opening 76 of the main body 51, to an upper section of the main body 51. The guiding mechanism 85 is detachably mounted to the main body 51.

The guiding mechanism 85 has a rotatable switching nail 86 to be situated adjacent to the outlet opening 76, for switching the output direction of a transfer charger sheet. As the switching nail 86 is operated, a sheet output from the outlet opening 76 is guided to the upper section of the main body 51, or is output directly to the front side of the main body 51.

The guiding mechanism 85 includes a sheet output roller 87 situated in the upper section of the mechanism, which is on the side of the main body 51, so that a sheet can be output onto the upper section of the main body 51.

The apparatus main body 51 has a stacker 89 at its upper section, for stacking and holding transfer charger sheets 88 output from the guiding mechanism 85. The stacker 89 is provided rotatable upward from the main body 51.

The stacker 89 has a holder plate 90 for holding the upper end side of the sheets 88 output on the stacker. The holder plate 90 is also provided rotatably upward from the stscker 89.

In the case where the stacker 89 is not used for holding the sheets 88, the holder plate 90 is closed down on the front side and set on the surface of the stacker 89, whereas in the case where the stacker 89 is used for holding the sheets 88, the holder plate is rotated upward to be stretched out.

The stocker 89 can be formed by adding the guiding mechanism 85 underneath the cover 82 of the apparatus shown in FIG. 6, and the holder plate 90 thereabove.

A developing device 67 of the image formation unit 641 is a toner supplement cartridge 83 as in the second embodiment.

When the image formation unit 641 is set in or removed from the main body 51, the stocker 89 is opened.

This apparatus also includes a sheet feeding cassette 91 located underneath the main body 51, and this cassette can be separated from the main body.

When the sheet feeding cassette 91 is set underneath the main body 51, an aligning protrusion 92 provided on the bottom surface of the main body 51 is fit into an aligning recess 93 formed on the upper surface of the sheet feeding cassette 91. The alignment of the sheet feeding cassette 91 with respect to the main body 51 can be thus carried out.

The sheet feeding cassette 91 includes a withdraw-type tray 94 for storing sheets 88, and a separation roller 95.

The tray 94 for storing sheets, has a push-up plate 96, on which transfer charger sheets 88 are stacked.

The tray 94 has a push-up spring 97 underneath the push-up plate 96 at a position corresponding to the separation roller 95. The push-up spring 97 serves to push up the push-up plate 96 such that the top surface of the stacked sheets 88 is pressed against the separation roller 95.

As the separation roller 95 rotates, the tray 94 feeds the sheets one by one.

The sheet feeding cassette 91 has a guide 98 at its rear portion, for guiding a sheet 88 separated by the separation roller 95, to the sheet conveying path 72 of the main body 51.

The main body 51 has a manual sheet feeding door 99 at its rear lower end, for manually feeding relatively thick sheets such as post cards or envelopes.

The main body 51 has a sheet feeding switching nail 100, provided rotatably near the sheet feeding roller 71, for selecting one of the following: sending a sheet from the paper feeding portion 53 to the conveying path 72, and sending a sheet inserted via the manual sheet feeding door 99 to the conveying path 72.

The sheet feeding cassette 91 has a stacker 101 on its upper surface at a position in front of the outlet opening 76 of the main body 51, for stacking sheets output directly from the outlet opening 76. The stacker 101 has a front end portion which can be slid forward so as to match with various sizes of sheets when they are stacked and held in the stacker 101.

Except for the above-described feature, this embodiment has the same structure as the first embodiment.

With the sheet feeding cassette 91 provided for this apparatus, a larger number of transfer charger sheets than that of the sheet feeding section 53 can be automatically fed, and therefore the apparatus is very useful when a great number of printings should be done at once.

Further, this apparatus is provided with the guiding mechanism 85, in which it suffices if the switching nail 86 is switched to the lower side for storing sheets output from the outlet opening 76 in the stacker 89 disposed in the upper section of the main body 51, or the switching nail is switched to the upper side for outputting sheets directly forward, and storing them in the stacker 101. Thus, an appropriate stacker can be selected in accordance with usage.

In similar to the first embodiment, with this embodiment, the apparatus can be downsized, a jammed sheet can be easily removed, and the thermal influence from the heat-fixation device on the optical unit can be avoided.

In these embodiments, the aligning recess is formed on the image forming unit, and the notch-like guide portion to be engaged with is formed in the main body, but the present invention is not limited to such a structure. The aligning recess may be formed in the image formation unit, and the protruding guide portion corresponding to the recess may be formed in the main body.

Further, a photosensitive member and a developer container are integrated into an image formation unit in the embodiments, but they may be handled as two or more divisional units.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image formation apparatus having an electrostatic latent image carrier with a photosensitive surface, for forming an image based on an electrophotographic system, comprising:

a charger for charging the photosensitive surface of said electrostatic latent image carrier;

an optical unit for forming an electrostatic latent image on the photosensitive surface of said electrostatic latent image carrier charged by the charger by exposing the photosensitive surface to scanning light applied onto the photosensitive surface;

a developing unit for forming a toner image on the photosensitive surface of the electrostatic latent image carrier by developing the electrostatic latent image formed by the optical unit with toner supplied from a toner box;

an image formation unit including at least the electrostatic latent image carrier and the developing unit;

a sheet feeder for feeding a receiving sheet on which the toner image is to be transferred;

transfer charger means for transferring the toner image formed on the photosensitive surface of the electrostatic latent image carrier onto the receiving sheet supplied from the sheet feeder; and a main body for accommodating the sheet feeder at a rear section and the optical unit in front of the sheet feeder, and the image formation unit which is settable into the main body from above;

wherein said optical unit is used to apply the scanning light onto the photosensitive surface of said electrostatic latent image carrier from above at an angle, and said developing unit has the toner box having a rear surface portion which is shaped to correspond to said optical unit, and a front surface portion which is shaped to correspond to an optical path through which the scanning light output from said optical unit is applied onto the photosensitive surface of said electrostatic latent image carrier.

2. An image formation apparatus according to claim 1, wherein said image formation unit comprises the charger, the electrostatic latent image carrier and the developing unit, all of which are integrated.

3. An image formation apparatus according to claim 1, wherein said image formation unit has a cover portion with an outer surface and said main body has an outer surface, with the outer surface of said cover portion and the outer surface of said main body being substantially flush with each other when said image formation unit is set into said main body.

4. An image formation apparatus according to claim 3, wherein said image formation unit has handles on peripheral left and right sides of the cover portion.

5. An image formation apparatus according to claim 1, wherein said main body has a cover openably provided at a position where the image formation unit is set into or removed from.

6. An image formation apparatus according to claim 1, wherein said optical unit includes a motor for rotating a rotor, a rectangular prism having two reflection surfaces for emitting a scanning light beam converted from light made incident on the reflection surfaces by rotation, a laser oscillator for oscillating a laser beam, a reflection mirror for reflecting a laser beam from the laser oscillator and radiating the laser beam onto the reflection surfaces of the rectangular prism, and a meniscus lens for focusing the reflected light from the reflection surfaces of the rectangular prism on the surface of the photosensitive member, all of which are integrated into a scanning unit.

7. An image formation apparatus having an electrostatic latent image carrier with a photosensitive surface, for forming an image based on an electrophotographic system, comprising:

a charger for charging the photosensitive surface of said electrostatic latent image carrier;

an optical unit for forming an electrostatic latent image on the photosensitive surface of said electrostatic latent image carrier charged by the charger by exposing the photosensitive surface to scanning light applied onto the photosensitive surface;

a developing unit for forming a toner image on the photosensitive surface of the electrostatic latent image carrier by developing the electrostatic latent image formed by the optical unit with toner supplied from a toner box;

an image formation unit including at least the electrostatic latent image carrier and the developing unit;

a sheet feeder for feeding a receiving sheet on which a toner image is transferred;

transfer charger means for transferring the toner image formed on the photosensitive surface of the electrostatic latent image carrier onto the receiving sheet supplied from the sheet feeder;

a heat fixation device for heat-fixing the receiving sheet on which the toner image was transferred by the transfer charger means; and a main body for accommodating the sheet feeder at a rear section, the optical unit in front of the sheet feeder, the heat fixation unit in a front section of the main body with the electrostatic latent image carrier interposed between the heat fixation unit and the optical unit, and the image formation unit which is settable into the main body from above, wherein said optical unit is used to apply the scanning light onto the photosensitive surface of said electrostatic latent image carrier from above at an angle, and said developing unit has the toner box having a rear surface portion which is shaped to correspond to said optical unit, and a front surface portion which is shaped to correspond to an optical path through which the scanning light output from said optical unit is applied onto the photosensitive surface of said electrostatic latent image carrier.

transfer charger means for transferring the toner image formed on the photosensitive surface of the electrostatic latent image carrier onto the receiving sheet supplied from the sheet feeder;

a heat fixation device for heat-fixing the receiving sheet on which the toner image was transferred by the transfer charger means; and a main body for accommodating the sheet feeder at a rear section; the optical unit in front of the sheet feeder, the heat fixation unit in a front section of the main body with the electrostatic latent image carrier interDosed between the heat fixation unit and the optical unit, and the image formation unit which is settable into the main body from above, wherein said optical unit is used to apply the scanning light onto the photosensitive surface of said electrostatic latent image carrier from above at an angle, and said developing unit has the toner box having a rear surface portion which is shaped to correspond to said optical unit, and a front surface portion which is shaped to correspond to an optical path through which the scanning light output from said optical unit is applied onto the photosensitive surface of said electrostatic latent image carrier.

8. An image formation apparatus having an electrostatic latent image carrier with a photosensitive surface, for forming an image based on an electrophotographic system, comprising:

a charger for charging the photosensitive surface of said electrostatic latent image carrier;

an optical unit for forming an electrostatic latent image on the photosensitive surface of said electrostatic latent image carrier charged by the charger by exposing the photosensitive surface to scanning light applied onto the photosensitive surface;

a developing unit for forming a toner image on the photosensitive surface of the electrostatic latent image carrier by developing the electrostatic latent image formed by the optical unit with toner supplied from a toner box;

an image formation unit including at least the electrostatic latent image carrier and the developing unit;

a sheet feeder for feeding a receiving sheet on which a toner image is transferred;

transfer charger means for transferring the toner image formed on the photosensitive surface of the electrostatic latent image carrier onto the receiving sheet supplied from the sheet feeder;

a main body for accommodating the sheet feeder at a rear section and the optical unit in front of the sheet feeder, and the image formation unit which is settable into the main body from above;

an aligning protruding portion or a recess portion formed in said image formation unit;

a guide portion formed in said main body, to be engaged with said aligning protruding portion or recess portion when said image formation unit is set in the main body;

wherein said optical unit is used for applying the scanning light onto the photosensitive surface of said electrostatic latent image carrier from above at an angle, and said developing unit has the toner box having a rear surface portion which is shaped to correspond to said optical unit, and a front surface portion which is shaped to correspond to an optical path through which the scanning light output from said optical unit is applied onto the photosensitive surface of said electrostatic latent image carrier.

9. An image formation apparatus having an electrostatic latent image carrier with a photosensitive surface, for forming an image based on an electrophotographic system, comprising:

a charger for charging the photosensitive surface of said electrostatic latent image carrier;

an optical unit for forming an electrostatic latent image on the photosensitive surface of said electrostatic latent image carrier charged by the charger by exposing the photosensitive surface to scanning light applied on the photosensitive surface;

a developing for forming a toner image on the photosensitive surface of the electrostatic latent image carrier by developing the electrostatic latent image formed by the optical unit with toner supplied from a toner box;

an image formation unit including at least the electrostatic latent image carrier and the developing unit;

a sheet feeder for feeding a receiving sheet on which the toner image is to be transferred;

transfer charger means for transferring the toner image formed on the photosensitive surface of the electrostatic latent image carrier onto the receiving sheet supplied from the sheet feeder;

a main body for accommodating the sheet feeder at a rear section and the optical unit in front of the sheet feeder, and the image formation unit which is settable into the main body from above;

a receiving sheet outlet formed in a front portion of said main body; and a guiding mechanism, provided at an outer section of the sheet outlet so as to be situated on said main body, for guiding a receiving sheet output from the sheet outlet to an upper portion of said main body;

wherein said optical unit is used for applying the scanning light onto the photosensitive surface of said electrostatic latent image carrier from above at an angle, and said developing unit has the toner box having a rear surface portion which is shaped to correspond to said optical unit, and a front surface portion which is shaped to correspond to an optical path through which the scanning light output from said optical unit is applied onto the photosensitive surface of said electrostatic latent image carrier.

10. An image formation apparatus according to claim 9, wherein said guiding mechanism has a switching nail to be situated adjacent to the outlet, for switching the output direction of a receiving sheet so that a sheet output from the outlet is guided to the upper section of said main body, or is output directly to a front side of said main body.

11. An image formation apparatus having an electrostatic latent image carrier with a photosensitive surface, for forming an image based on an electrophotographic system, comprising:

a charger for charging the photosensitive surface of said electrostatic latent image carrier;

an optical unit for forming an electrostatic latent image on the photosensitive surface of said electrostatic latent image carrier charged by the charger by exposing the photosensitive surface to scanning light applied on the photosensitive surface;

a developing unit for forming a toner image on the photosensitive surface of the electrostatic latent image carrier by developing the electrostatic latent image formed by the optical unit with toner supplied from a toner box;

an image formation unit including at least the electrostatic latent image carrier and the developing unit;

a sheet feeder for feeding a receiving sheet on which a toner image is transferred;

transfer charger means for transferring the toner image formed on the photosensitive surface of the electrostatic latent image carrier onto the receiving sheet supplied from the sheet feeder;

a main body for accommodating the sheet feeder at a rear section and the optical unit in front of the sheet feeder, and the image formation unit which is settable into the main body from above; and a sheet feeding cassette provided detachably on a bottom surface of said main body, for feeding a sheet selectively in cooperation with said sheet feeder;

wherein said optical unit is used for applying the scanning light onto the photosensitive surface of said electrostatic latent image carrier from above at an angle, and said developing unit has the toner box having a rear surface portion which is shaped to correspond to said optical unit, and a front surface portion which is shaped to correspond to an optical path through which the scanning light output from said optical unit is applied onto the photosensitive surface of said electrostatic latent image carrier.

12. An image formation apparatus having an electrostatic latent image carrier with a photosensitive surface, for forming an image based on an electrophotographic system, comprising:

a charger for charging the photosensitive surface of said electrostatic latent image carrier;

an optical unit for forming an electrostatic latent image on the photosensitive surface of said electrostatic latent image carrier charged by the charger by exposing the photosensitive surface to scanning light applied on the photosensitive surface;

a developing unit for forming a toner image on the photosensitive surface of the electrostatic latent image carrier by developing the electrostatic latent image formed by the optical unit with toner supplied from a toner box;

an image formation unit including at least the electrostatic latent image carrier and the developing unit;

a sheet feeder for feeding a transfer charger sheet on which the toner image is to be transferred; and transfer charger means for transferring the toner image formed on the photosensitive surface of the electrostatic latent image carrier onto the receiving sheet supplied from the sheet feeder;

a main body for accommodating the sheet feeder at a rear section and the optical unit in front of the sheet feeder, and the image formation unit which is settable into the main body from above;

a receiving sheet outlet formed in a front portion of said main body;

a guiding mechanism, provided at an outer section of the sheet outlet so as to be situated on said main body, for guiding a receiving sheet output from the sheet outlet to an upper portion of said main body;

a sheet feeding cassette provided detachably on a bottom surface of said main body, for feeding a sheet selectively in cooperation with said sheet feeder;

a stacker, provided on an upper surface of said sheet feeding cassette situated in front of the outlet of said main body, for stacking and holding sheets; and a switching nail to be situated adjacent to the outlet, for switching the output direction of a receiving sheet so that the receiving sheet is guided to the guiding mechanism, or is output to the stacker;

wherein said optical unit is used for applying the scanning light onto the photosensitive surface of said electrostatic latent image carrier from above at an angle, and said developing unit has the toner box having a rear surface portion which is shaped to correspond to said optical unit, and a front surface portion of which is shaped to correspond to an optical path through which the scanning light output from said optical unit is applied onto the photosensitive surface of said electrostatic latent image carrier.

* * * * *